United States Patent [19]

Orban

[11] Patent Number: 4,548,103

[45] Date of Patent: Oct. 22, 1985

[54] STUD DRIVE TOOL

[76] Inventor: Joseph N. Orban, 12 Greensview Dr., Scotch Plains, N.J. 07076

[21] Appl. No.: 249,946

[22] Filed: Apr. 1, 1981

[51] Int. Cl.[4] ..... B25B 13/50

[52] U.S. Cl. ..... 81/53.2; 81/57.35; 81/57.38; 81/445

[58] Field of Search ..... 81/57.38, 57.39, 459, 81/443, 444, 445, 57.4, 57.41, 57.24, 57.25, 57.35, 53.2; 294/95, 96, 97

[56] References Cited

U.S. PATENT DOCUMENTS

| | | | |
|---|---|---|---|
| 1,386,455 | 8/1921 | Clemens | 81/57.11 |
| 2,497,633 | 2/1950 | Shapiro et al. | 81/445 |
| 3,075,800 | 1/1963 | Rowekamp | 294/95 |
| 4,266,451 | 5/1981 | Boudet et al. | 81/57.41 |

*Primary Examiner*—James L. Jones, Jr.
*Attorney, Agent, or Firm*—Edward R. Weingram

[57] ABSTRACT

A stud drive tool for threading and unthreading a stud in a head of a vessel, such as a reactor, including a base plate adapted to rest on a flange on the head of vessel. The tool includes means for inserting the stud into a hole in the vessel and to thread and unthread the stud therein.

The base plate effectively absorbs any counter-torque produced by the turning of the stud while it is being driven because handles, which serve as reaction rods and guides, are rotatable and rest against the outside of the flange.

The tool for threading and unthreading the stud means includes a moveable jaw clamp insertable into a threaded hole in the top of the stud and moveable into a position to clasp the stud and pneumatic means in which the pressure is manually regulated to equalize the weight of the stud as it is being threaded into or unthreaded out of the vessel, and an air motor which turns the stud.

2 Claims, 10 Drawing Figures

28
26
29a
29a
29
27
52
53
25a
29
23
24a
25
24

28
29
26
29
27
53
25
23
24

STUD DRIVE TOOL

BACKGROUND OF THE INVENTION

The invention relates to a device, or tool, for threading and unthreading a stud, or fastening member, into and out of a vessel, such as a reactor vessel.

The cover of a vessel such as a reactor is generally secured by studs which pass thru holes in the vessel and are pre-tensioned to securely hold the cover in place. Normally, the studs extend above the cover so that either the cover would have to be lifted off the studs, or, as is generally more convenient because of space limitations after the studs are detensioned, the studs are removed from the vessel.

In many cases, the vessel is housed in a structure and the studs project upwardly from the vessel with a cover placed over the vessel opening. When the studs are detensioned, the cover cannot be lifted over the projecting studs because of space limitations.

It is known to drive studs into and out of a pressure vessel using an air motor which forms part of a tool suspended from a crane which lowers or raises the tool. When lowered, a socket at the lower end of the tool fits over a collar on the stud. With the stud lowered into a hole in the vessel, the crane operator controls an air motor which causes the stud to rotate in one or the other direction, depending upon whether the stud is threaded into or out of the vessel.

Since the studs are large and each weigh between 500 and 1000 pounds, they produce a counter-torque which can be dangerous because the controls are such that the operator takes up the torque. Despite the fact that the tool incorporates a reduction gear which reduces the torque absorbed by the operator, if the operator does not exercise due care, and activates the control inadvertently, he could be caught off balance, and be seriously injured.

SUMMARY OF THE INVENTION

To overcome the problems of the prior art the invention provides a stud driving tool with a control and reaction rod which pivots and fits over the outside diameter of the cover flange on the vessel and absorbs the counter-torque produced as the stud is threaded and unthreaded. The stud device operation is thus siimplified and fast. The tool is connected to the crane hook and to an air supply. The tool, which hangs free, is moved by the crane directly over the stud and nut, and lowered until it rests squarely on the flange surface. The stud drive mechanism will now be resting on top of the stud. A gentle jogging with a control handle will allow the drive mechanism to align itself and drop into position. The operator then lowers the gripping mechanism into a threaded hole in the top of the stud. The operator locks the mechanism to grip the stud and regulates an air supply to a cylinder in which a piston connected to the locking mechanism lifts the stud equalizing the weight of the stud on the threads. The operator then pushes the control handle upward, or downward to thread or unthread the stud. After the operation is complete the gripping mechanism is released and the tool is moved to the next stud.

The tool for threading and unthreading the stud includes a moveable jaw clamp insertable into a threaded hole in the top of the stud and moveable into a position to clasp the stud and pneumatic means in which the pressure is manually regulated to equalize the weight of the stud as it is being threaded into or out of the vessel, and an air motor which turns the stud.

It is therefore an object of the invention to provide a new, and improved stud-driving tool for inserting and removing studs into and out of a pressure vessel in which the counter-torque produced by insertion and removal of the stud is absorbed by the tool and vessel rather than by the operator.

A further object of the invention is to provide a new and improved stud driving tool for facilitating the insertion and removal of studs in a pressure vessel requiring reduced operator effort.

Another object is that when the tool is resting on the flange, it is completely independent of the crane, used to put the tool in place. The gripping mechanism reduces the time required to connect to the stud.

A still further object of the invention is to provide a new and improved stud driving tool for the insertion and removal of studs in a pressure vessel which is safer to operate and requires less manpower.

Another object of the invention is provide a new and improved driving mechanism for threading the stud into and out of a pressure vessel requiring less operator effort and less time to thread and unthread the stud.

Yet another object of the invention is to provide a new and improved stud drive tool equipped with load compensation which requires setting only once the first stud is to be inserted or removed, and thereafter remains fixed for the other studs.

A still further object of the invention is to provide a new and improved stud driving tool for inserting and removing studs from a pressure vessel having torque compensation to prevent injury to the operator, load compensation which requires only a single setting on the first stud, and a movable jaw mechanism controlled by the operator for threading and unthreading the studs.

Other objects and advantages will be apparent from the description of the illustrated embodiment of the invention, and the novel features will be particularly pointed out hereinafter in the claims.

BRIEF DESCRIPTION OF THE DRAWINGS

A preferred embodiment of the invention will be described with reference to the accompanying drawings in which.

DESCRIPTION OF THE PREFERRED EMBODIMENT

Figure 1:
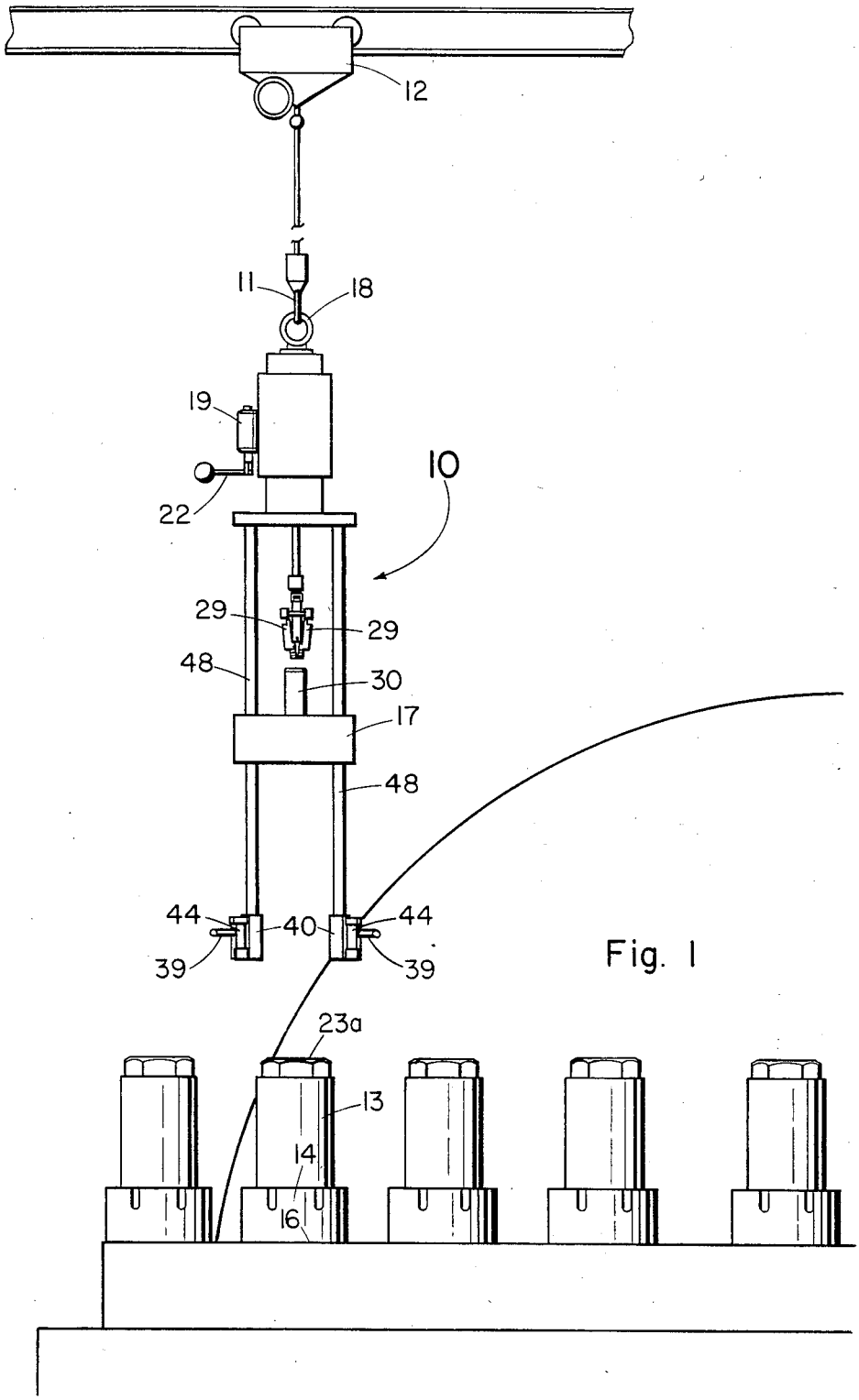
FIG. 1 is an elevational view of the stud driving tool suspended above a pressure vessel by an overhead crane.

The stud drive tool 10 is connected to a crane hook 11 and to a 100–150 pounds per square inch (PSI) air supply (FIG. 1). The crane 12 is used to place the freely hanging tool directly over a tension stud 13 which is threaded into nut 14. The tool is then lowered until it rests squarely on the flange surface 16. The stud drive mechanism 17 will now be resting on top of the stud suspended by an eye-bolt 18 carried by the crane hook.

Figure 2A:
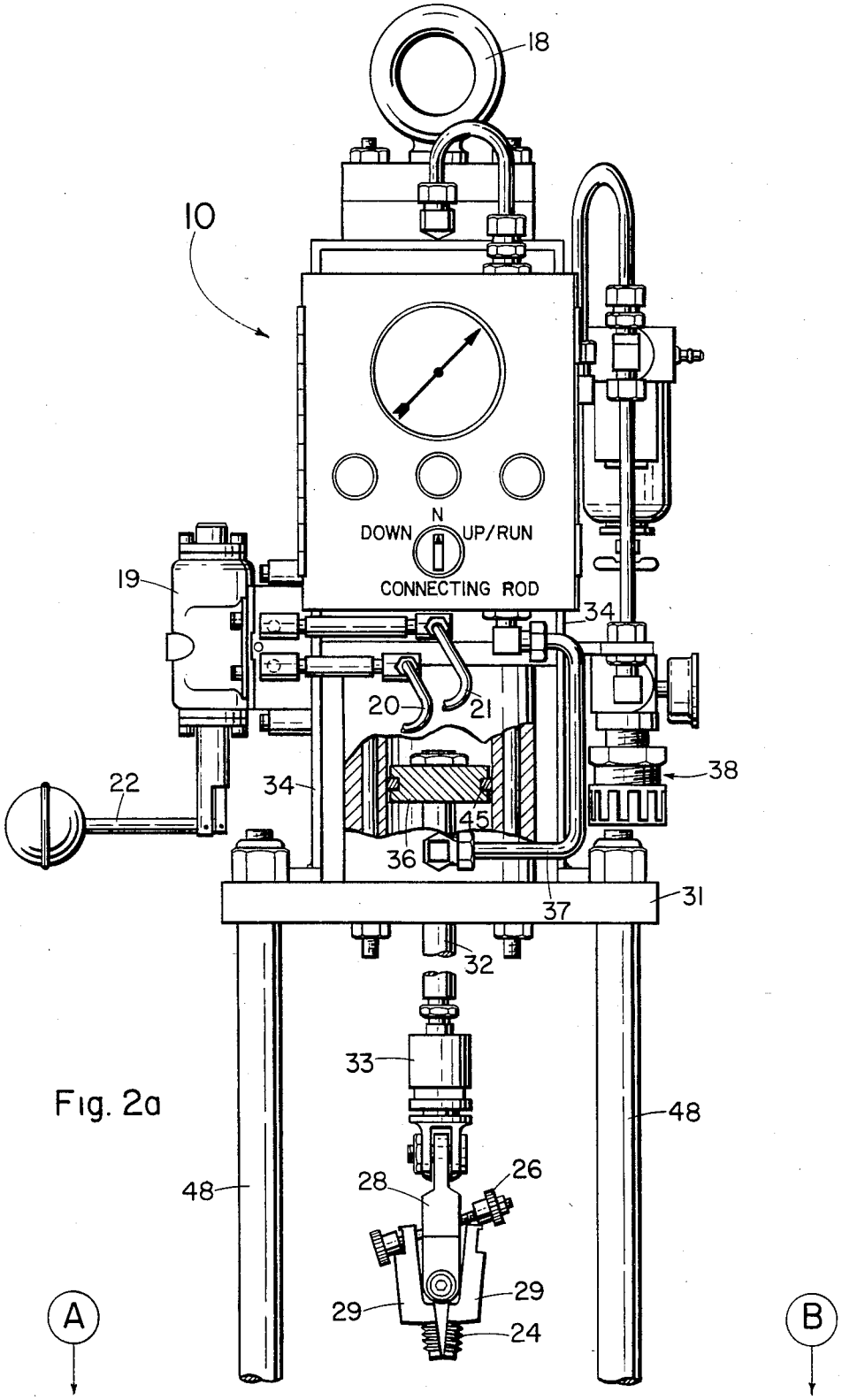
FIG. 2*a* is a front sectional view, of the stud upper portion of the driving tool positioned on the cover of the pressure vessel with the stud holding mechanism closed.
Figure 2B:
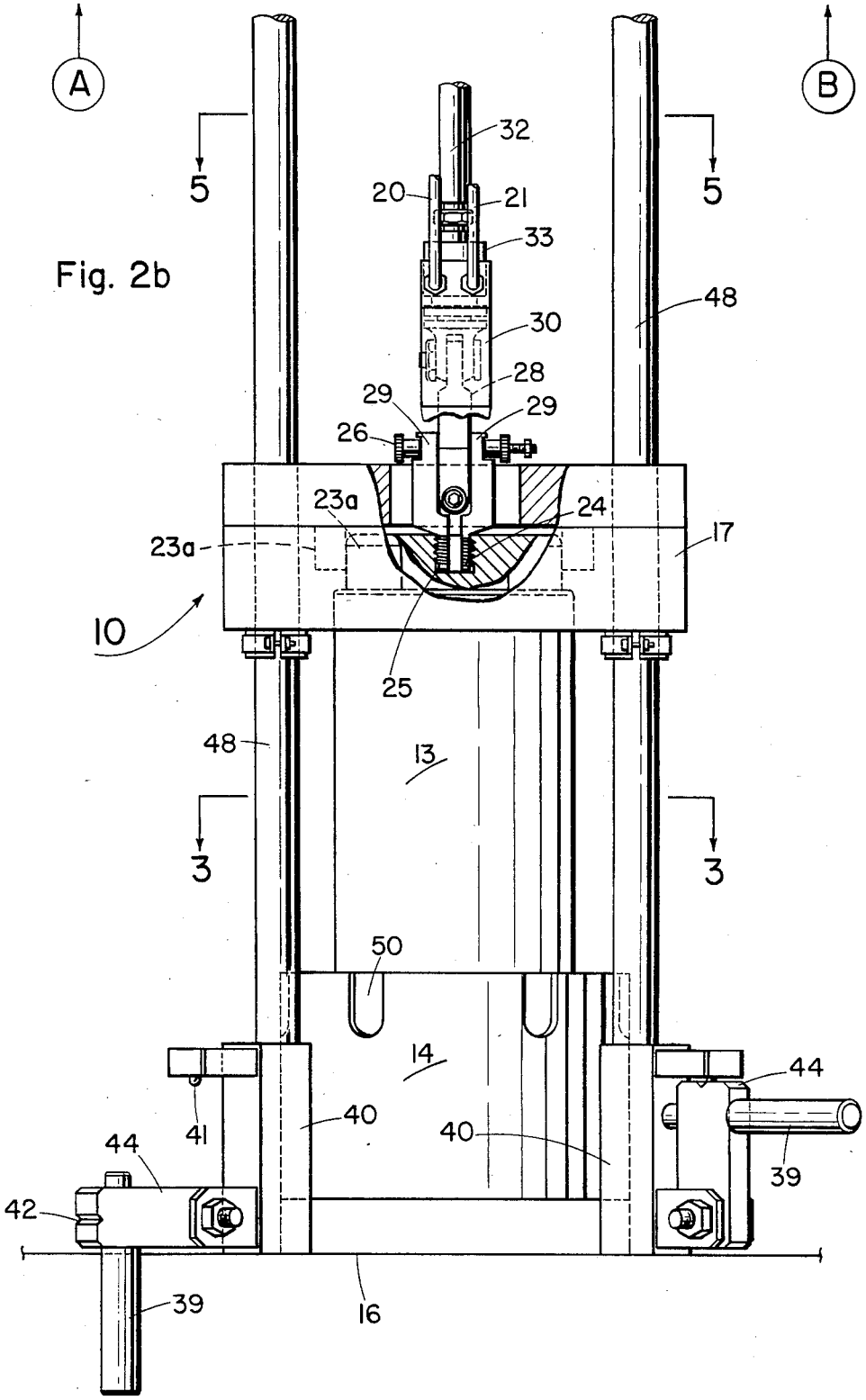
FIG. 2*b* is a front elevational view, partially in section, of the lower portion of the stud driving tool showing in greater detail the stud holding mechanism engaged.
Figure 3:
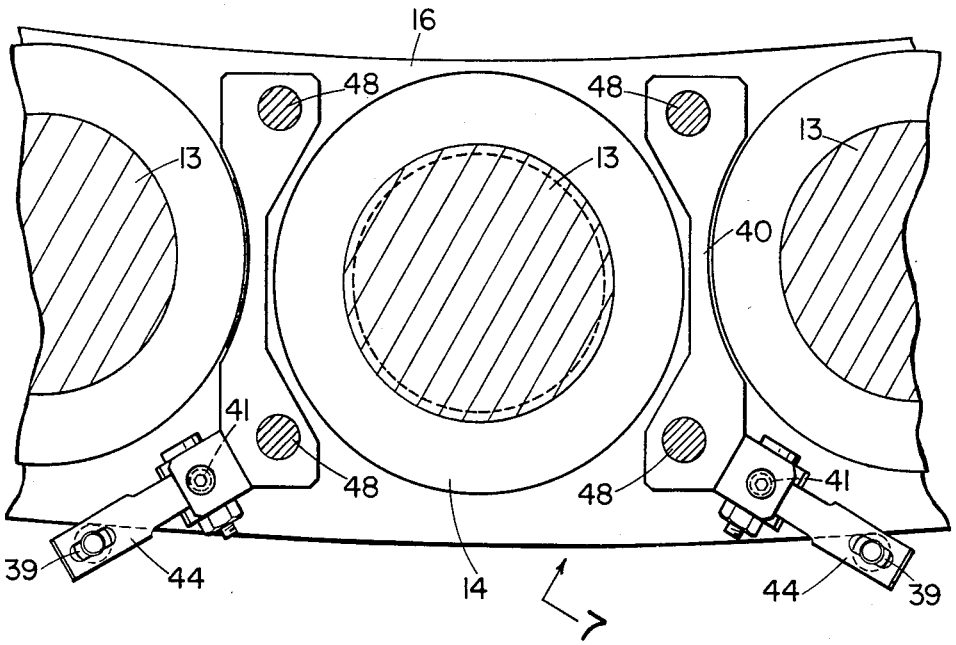
FIG. 3 is a plan view, partially in section, through the plane 3—3 in FIG. 2*b;*
Figure 4:
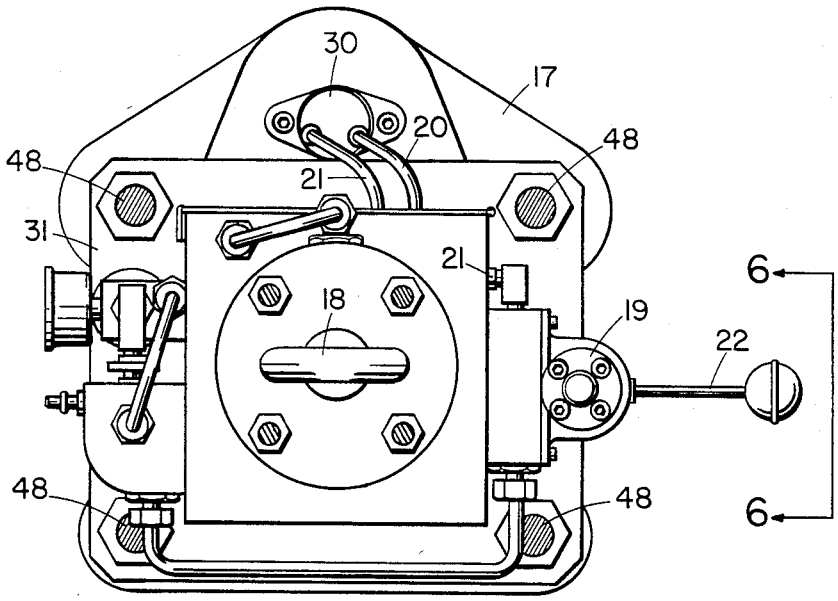
FIG. 4 is a plan view from the top of FIG. 2*a;*
Figure 8:
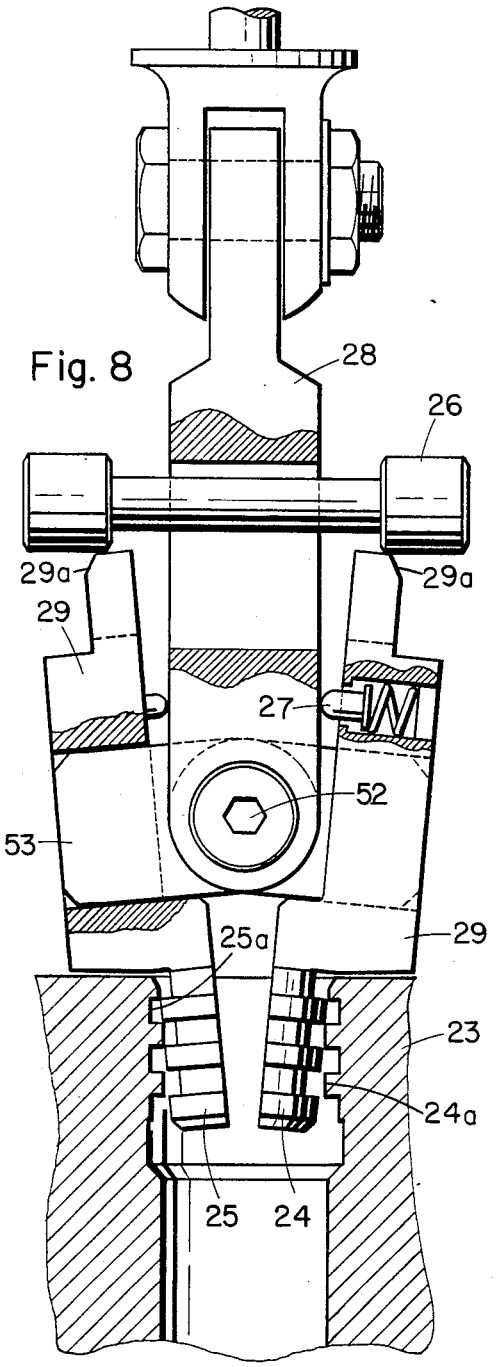
FIG. 8 is a sectional view of the jaw clamp in the unlocked position inserted into the end of the stud.
Figure 9:
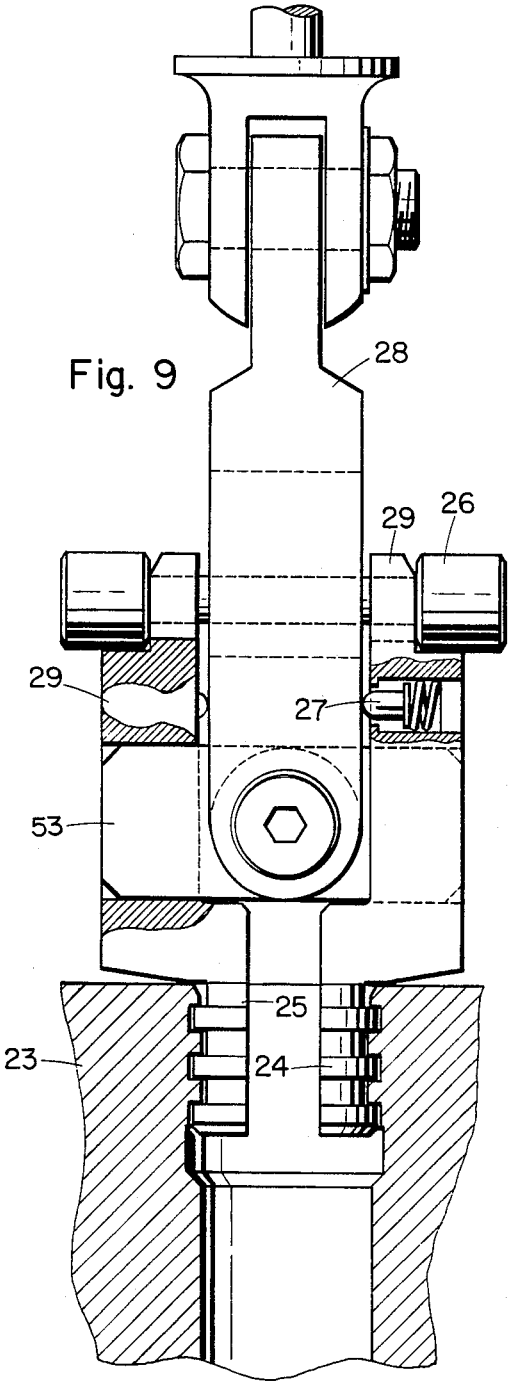
FIG. 9 is a sectional view of the jaw clamp in the locked driving position in the end of the stud.

The stud drive mechanism 17 is driven by an air motor 30 connected to an air supply of 100–150 PSI through a control valve 19 by hoses 20, 21 (FIG. 2*b*). The direction and speed of the stud drive mechanism is controlled by a valve control handle 22 shown in FIGS. 1 & 2*a*. The stud drive mechanism includes a hexagonal socket 23 thru which the stud gripping or engaging assembly, which includes movable jaws 24, passes as shown in FIGS. 2*a* and 2*b*. The jaws 24 are inserted into threaded hole 25 in head 23*a* of stud 13 with the jaws 24 closed and locking pin 26 placed over the ends 29*a* of extensions 29 of jaws 24 and tightened to swivel the threaded ends of the jaws into engagement with threaded hole 25 in head 23*a* of stud 13. These threads may be either v-shaped as shown in FIG. 2, or square, as shown in FIGS. 8 & 9. The threads may also be external, rather than internal, as shown, in which case the gripper would have to have internal threads and clamp over a corresponding element (not shown) on the head 23*a* of the stud. To disconnect the jaw gripping assembly (see FIG. 8), the jaws are closed by releasing a locking pin 26 allowing a spring plunger 27 acting against a clevis 28 to close the jaws.

To thread or unthread the stud in the vessel, the stud gripping assembly is inserted into the threaded hole 25 in the top 23*a* of an untensioned stud 13 and the jaws closed (FIG. 9) and securely fixed in position by the locking pin 26 which controls extensions 29, which are supported by inserts 53 rotatable on pin 52, to firmly grip clevis 28.

The weight of stud 13 is equalized by mechanism 34 which includes a cylinder in which a piston 36 sealed by a ring 45 moves as result of air under pressure being introduced through passage 37 (FIG. 2). Consequently, the stud, weighing over 1000 pounds is sitting on its threads in a threaded hole, and with the air pressure adjusted by regulator 38 in the support mechanism floats on those threads, i.e., just enough air is supplied until the stud is lifted off the threads by rod 32 connected to clevis 28 by a coupling 33.

The drive tool 10, positioned over the head 23*a* of the stud is guided into place by guide handles 39 which rest against the outer diameter of the flange and are secured to base plate 40 which is contoured (scalloped) to fit between adjacent nuts.

Figure 7:
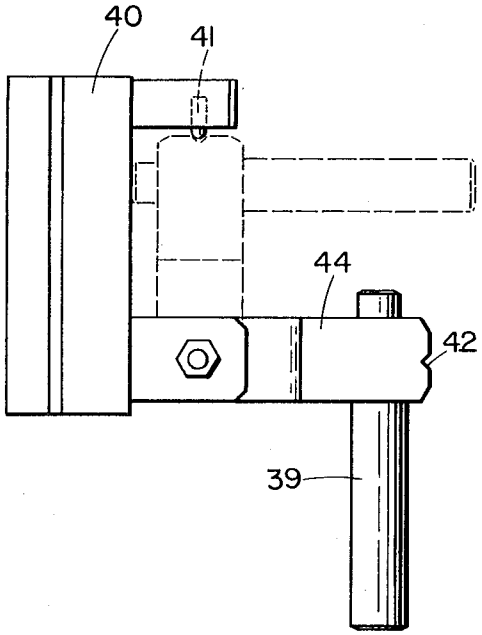
FIG. 7 is an elevational view, partly in section, of the guide and reaction rod along the lines 7—7 in FIG. 3.
Figure 6:
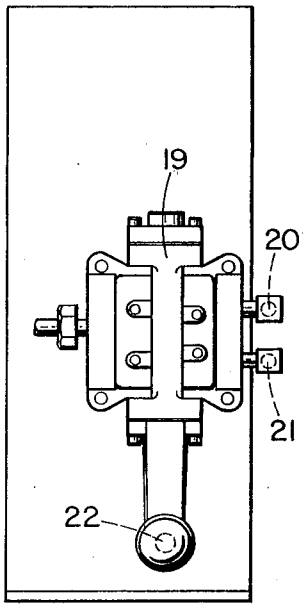
FIG. 6 is a side elevational view taken along the lines 6—6 of FIG. 4.
Figure 5:
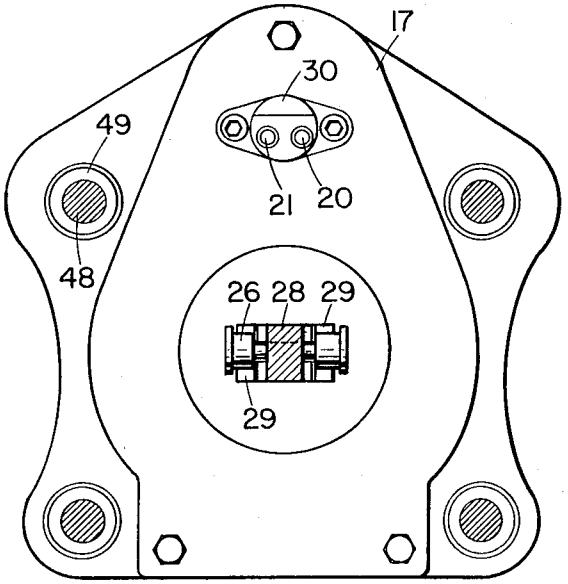
FIG. 5 is a sectional plan view taken along the lines 5—5 in FIG. 2*b;*

Handle 39 extends horizontally for guiding the tool over the stud which is shown in FIG. 2 and in dotted lines in FIG. 7. It is held in this position by a spring loaded catch 41 which fits into a detent 42 of arm 44. Moving the handles downwardly removes the spring-loaded catch from the detent and causes the handle to rest up against the outside of the flange. In this position, the handle serves to absorb the counter-torque produced when the stud is threaded in to or out of the vessel.

After lowering the tool on the stud the hexagonal socket 23 in the stud drive mechanism 17 must be suitably positioned over head 23*a* of stud 13 by jogging handle 22 which has three positions, the center position being the neutral position. When the handle is pressed up, the stud will be turned counter-clockwise so that it is threading the stud out. When the handle is pressed down, the stud will turn clockwise, threading the stud down or in.

When the assembly is aligned, connecting rod 32 carrying the stud-gripping assembly drops down into a threaded hole 25 in the top 23*a* of the stud which receives the jaws 24. Jaws 24 are opened then to engage threaded hole 25 in the head 23*a* of the stud. Air cylinder 34 is then energized by adjusting regulator 38 which will supply air through passage 37 underneath piston 36 sealed by ring 45. The air regulator is adjusted to lift the stud to cause it to float thus relieving the load of the stud on the threads.

With handle 22 pushed downward air motor 30 drives the stud through mechanism socket 23 in drive 17.

Motor 30 is a reversible air motor. Depending upon which way the handle is depressed, air enters the motor on one or the other side through air lines 20, 21, (FIG. 2*a*) and depending upon which side the air enters through the air lines determines which direction the motor will turn.

When the stud is completely removed, a spacer is inserted between the nut 14 and cover 16. The entire tool 10 is supported by four tie-rods 48.

Nut 14 has lugs 50 which are rotated when the stud is tensioned to secure the the cover of the vessel.

Thus, to insert or remove a stud, the tool is lowered so that the driving mechanism 17 is over the top 23*a* of the stud 13, and guided into place by handles 39, which are now in their horizontal position, and supported by arm 44. The jaws 29 are inserted into the threaded hole 25 in top 23*a* of the stud 13 and air is introduced into cylinder 34 to counter-balance the stud, and handles 39 are rotated to rest against the outside of the flange. After the tool has come to rest on the flange, air motor 30 is activated and the stud threaded into, or out of the vessel by rotation of socket 23. This operation is repeated until all studs are removed, and together with the cover are lifted off the vessel and placed on the floor. During insertion and removal of the studs, handles 39, resting against the outside of the flange absorb the counter-torque produced by threading and unthreading of the stud and thereby preventing injury to the operator.

It will be understood that various changes in the details, materials, arrangements of parts and operating conditions which have been herein described and illustrated in order to explain the nature of the invention, may be made by those skilled in the art within the principles and scope of the invention.

What is claimed is:

1. A stud drive tool comprising:

a base plate adapted to rest on a flange of a vessel receiving a stud;

means secured to the base plate to insert a stud into or remove the stud from an aperture in the flange including:

a stud driving mechanism for rotating the stud including a socket, driven by an air motor adapted to fit over the top of the socket;

piston controlled means to support and equalize the weight of the stud during inserting into and removal from the flange, including:

a jaw clamp insertable into a threaded hole in the top of said stud, to support and equalize the weight of the stud, the jaw clamp is threaded to engage internal threads in the cavity of the stud; and wherein the jaws of the clamp are resiliently coupled and inserted closed into the stud cavity and opened in the cavity to lift the stud and compensate for the weight of the stud; and means to absorb counter-torque produced as the stud is inserted into or removed from the flange, said counter-torque absorbing means including a reaction rod adapted to rest against the flange during insertion into or removal of the stud from the flange of the vessel.

2. A stud drive tool as in claim 1 wherein the jaws of the clamp are resiliently secured to a clevis.

* * * * *